US005722900A

United States Patent [19]

Sung

[11] Patent Number: 5,722,900

[45] Date of Patent: Mar. 3, 1998

[54] STRUCTURE OF GOLF CLUB HEAD

[76] Inventor: Chung Jong Sung, 7F-2, No. 87, Kuang Ming Street, Kaobsiung, Taiwan

[21] Appl. No.: 508,960

[22] Filed: Jul. 28, 1995

[51] Int. Cl.[6] ..... A63B 53/04

[52] U.S. Cl. ..... 473/291; 473/350

[58] Field of Search ..... 273/167 R, 167 F, 273/167 H, 169, 167 A, 193 R, 194 R, 197 D; 473/291, 350

[56] References Cited

U.S. PATENT DOCUMENTS

| | | | |
|---|---|---|---|
| 1,617,090 | 2/1927 | Worthington | 273/167 A |
| 3,655,188 | 4/1972 | Solheim . | |
| 3,751,035 | 8/1973 | Lockwood | 273/167 R |
| 4,420,156 | 12/1983 | Campau | 273/169 |
| 4,645,207 | 2/1987 | Teramoto | 273/167 H |
| 4,715,601 | 12/1987 | Lamanna | 273/77 A |

FOREIGN PATENT DOCUMENTS

| | | | |
|---|---|---|---|
| 924103 | 4/1963 | United Kingdom | 273/167 A |

*Primary Examiner*—Sebastiano Passaniti
*Attorney, Agent, or Firm*—Pro-Techtor International

[57] ABSTRACT

A golf club head including a casing and a neck at one end of the casing for connection of a club shaft, the casing having a front wall of uniform thickness defining a striking surface, a smoothly curved back wall connected to the front wall by a solid bottom wall and defining with the front wall an upwardly back chamber for permitting the center of gravity of the golf club head to be changed vertically by changing the depth of the back chamber and changed horizontally by sloping the bottom side of the back chamber forwards or backwards.

3 Claims, 4 Drawing Sheets

STRUCTURE OF GOLF CLUB HEAD

BACKGROUND OF THE INVENTION

The present invention relates to golf club heads, and relates more particularly to the design of a golf club head for different numbers of iron clubs.

When playing the game of golf, different clubs including numbers 1, 3, 4, 5, and 7 of wooden clubs or numbers from 1 to 10 of iron clubs, and putters shall be used in different conditions. An iron club of a bigger number has a relatively shorter shaft and can drive the ball through a higher trajectory to a shorter distance. On the contrary, an iron club of a smaller number has a relatively longer shaft and can drive the ball through a lower trajectory to a longer distance. Therefore, iron clubs of bigger numbers are more suitable for the beginners while iron clubs of smaller numbers are more suitable for skillful players. The center of gravity of the club head of a golf club has great concern with the trajectory of the ball. As illustrated in FIG. 1, when the center of gravity of the club head is shifted to a higher elevation A, the trajectory A1 becomes lower; when the center of gravity of the club head is shifted to a lower elevation C, the trajectory C1 becomes higher. Therefore, adjusting the center of gravity is very importance in the fabrication of golf club heads. Regular golf club heads for golf clubs are commonly gathered into three groups, namely, the solid club heads, the wooden club heads, and the club heads with a back chamber. A solid club head has a very small sweet spot. Therefore it is difficult to control the flying direction of the ball when using a solid club head. Another drawback of solid club heads is that they produce shocks heavily which striking against the ball, causing the player's arms vibrated, and therefore the player's arms tend to be injured. Nowadays, solid club heads have been gradually abandoned. A wooden club head has a big dimension but is lightweight. It is complicated to manufacture a wooden club heads. In order to adjust the center of gravity of a wooden club head to the desired location, a back-weight design is necessary. This back-weight design is achieved by adding a counterweight to the back side of the club head or threading heavy screws into screw holes made on the bottom side of the club head. A club head with a back chamber is used in iron clubs. As illustrated in FIG. 2, the club head 10 has a back chamber 20 at the back side. The shape of the back chamber 20 fits the configuration of the club head 10. The design of the back chamber 20 permits the gravity of the club head 10 to be distributed over the border so that the sweet spot is relatively increased. Because the shape of the back chamber 20 fits the configuration of the club head 10, the center of gravity 30 is constantly maintained in the same line D when the size and weight of the club head 10 are changed to fit different numbers of clubs. Therefore, the vertical distance between the center of gravity 30 and the longitudinal central axis of the shaft 40 of the club does not change so much when the size and weight of the club head 10 are changed. Furthermore, during the fabrication of a club head with a back chamber, it is difficult to accurately control the location of the center of gravity.

SUMMARY OF THE INVENTION

The present invention has been accomplished under the circumstances in view. It is therefore an object of the present invention to provide a golf club head with a back chamber which is easy to manufacture.

It is another object of the present invention to provide a golf club head with a back chamber which can be conveniently adjusted to change its center of gravity to fit different numbers of clubs during its fabrication. According to the present invention, the golf club head comprises a casing and a neck at one end of the casing for connection of a club shaft, the casing having a front wall of uniform thickness defining a striking surface, a smoothly curved back wall connected to the front wall by a solid bottom wall and defining with the front wall an upwardly back chamber for permitting the center of gravity of the golf club head to be changed vertically by changing the depth of the back chamber and changed horizontally by sloping the bottom side of the back chamber forwards or backwards.

DETAILED DESCRIPTION OF THE PREFERRED EMBODIMENT

Figure 1:
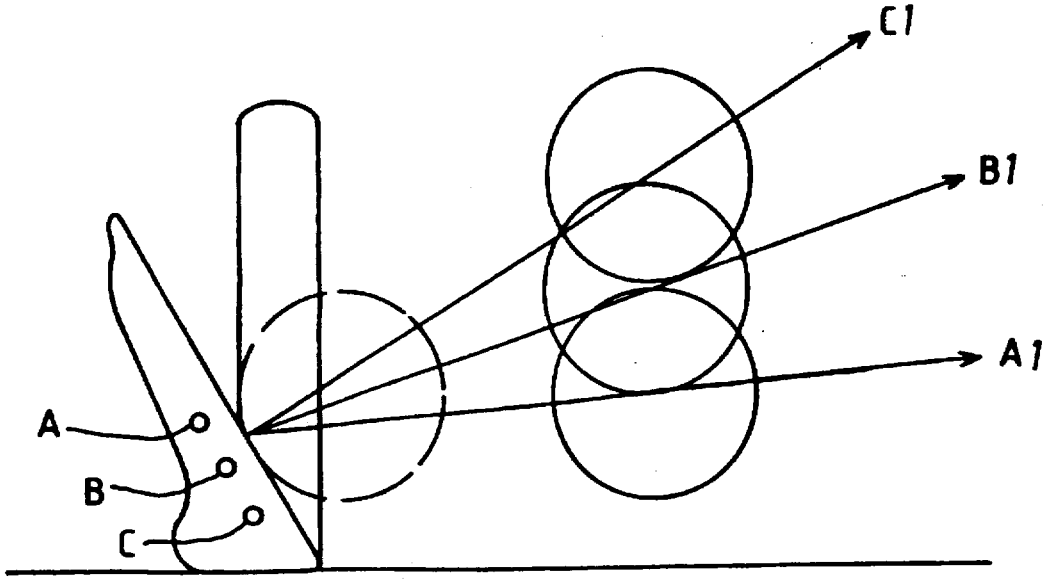
FIG. 1 is a schematic drawing explaining the relationship between the center of gravity of the club head and the trajectory of the ball.
Figure 2:
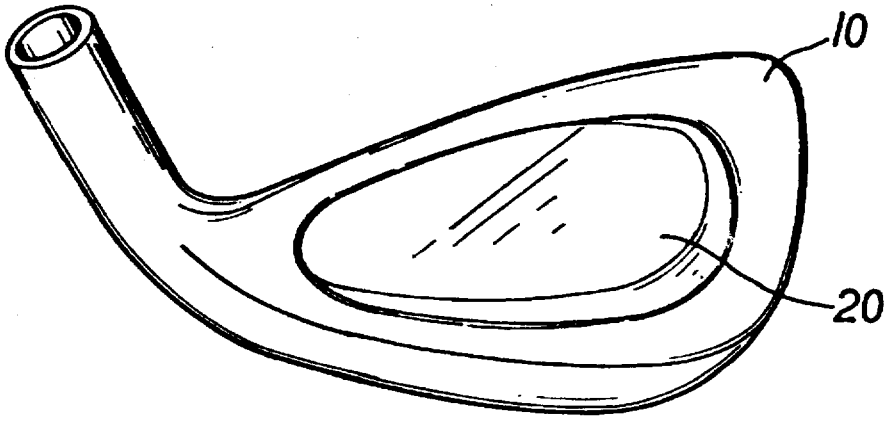
FIG.2 (PRIOR ART)
FIG. 2 is a perspective view of a golf club with a back chamber according to the prior art.
Figure 3:
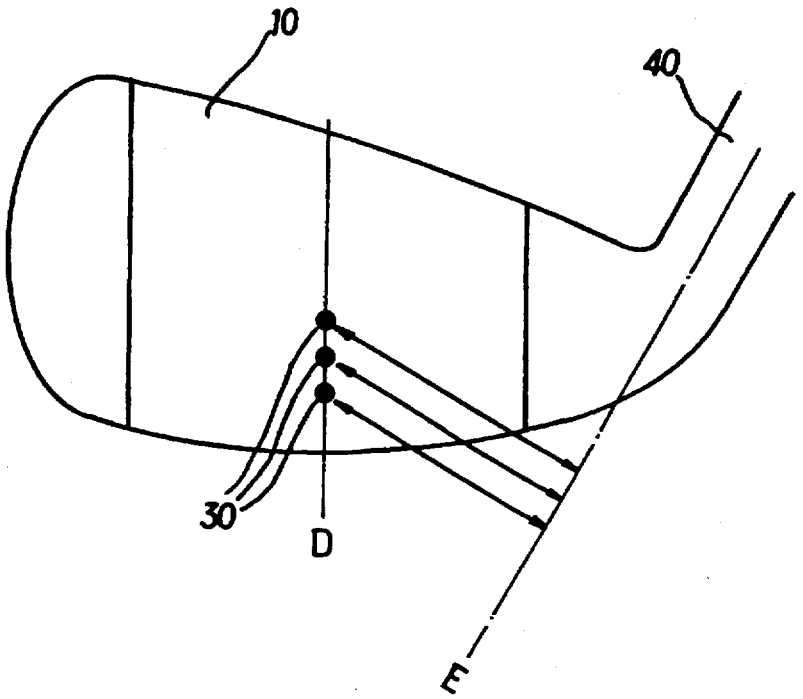
FIG. 3 (PRIOR ART)
FIG. 3 is a schematic drawing explaining the relationship between the center of gravity and the torque according to the prior art.
Figure 4:
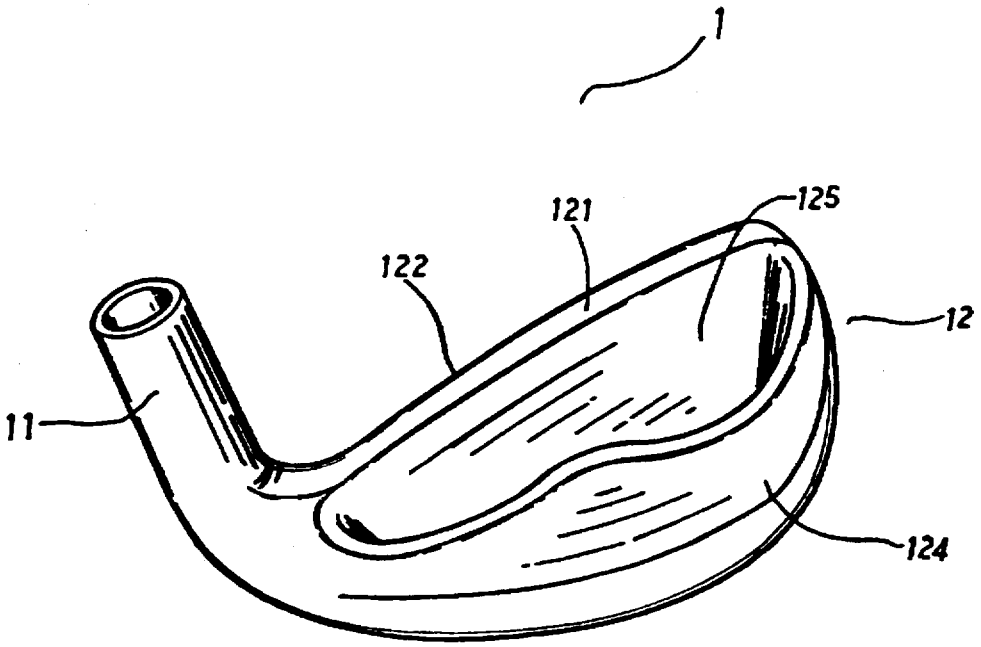
FIG. 4 is a perspective view of a golf club head according to the present invention.
Figure 5:
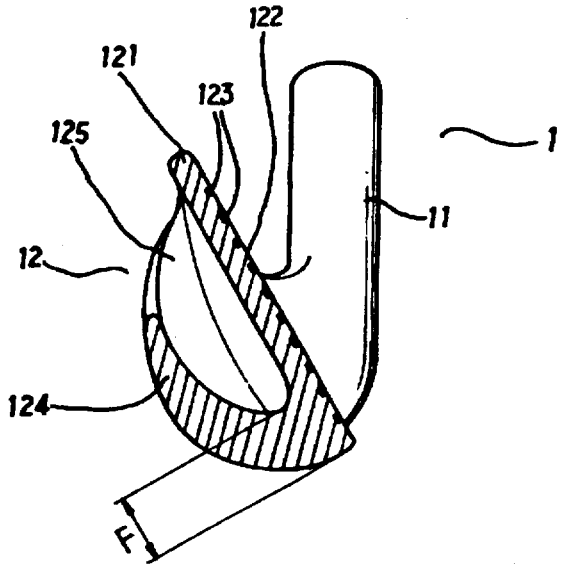
FIG. 5 is a sectional view of the golf club head shown in FIG. 4.

Referring to FIGS. 4 and 5, the golf club head comprises a casing 12 and a neck 11 at one end of the casing 12 for connection to a club shaft. The casing 12 comprises a front wall 121 of a uniform thickness, a striking surface 122 defined within the front wall 121, a plurality of scoring lines 123 on the striking surface 122, a smoothly curved back wall 124 extended from the front wall 121, and an upwardly disposed back chamber 125 defined within the back wall 124. A solid bottom wall of a thickness (height) F is defined between the bottom side of the upwardly disposed back chamber 125 and the bottom side of the casing 12 (see FIGS. 5 and 6).

Figure 6:
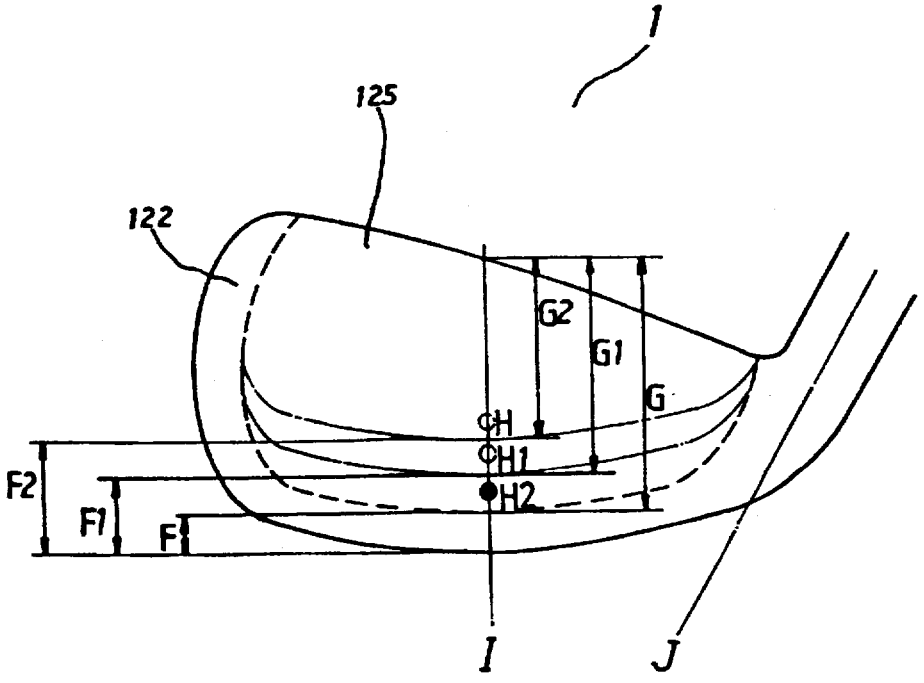
FIG. 6 is a schematic drawing showing the change of the location of the center of gravity of the club head in the vertical direction according to the present invention.

Referring to FIG. 6, by changing the depth of the back chamber 125 (i.e., changing the thickness F), the club head 1 fits different numbers of clubs. For example, when the depth of the back chamber 125 is set as G, the center of gravity of the club head 1 is at point H, and the thickness of the solid bottom wall is F. This arrangement is suitable for a golf club of a smaller number. For a golf club of a higher number, the center of gravity is at a lower elevation (for example, at point H1 or H2), therefore the depth of the back chamber 125 is less deep (for example G1 or G2) and the thickness of the solid bottom wall is F1 or F2. The thickness ("thickness" being defined as the distance between the front wall 121 and the back wall 124) of the back chamber 125 is preferably within 3 mm to 20 mm. Therefore, by changing the depth of the back chamber 125, the center of gravity of the club head 1 is relatively changed.

Figure 7:
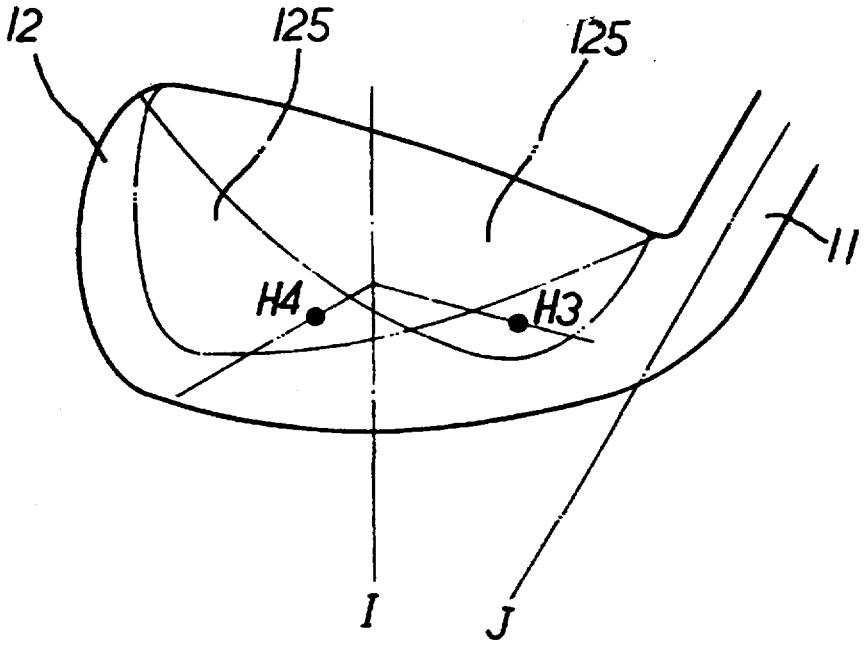
FIG. 7 is a schematic drawing showing the change of the location of the center of gravity of the club head in the horizontal direction according to the present invention.
Figure 8:
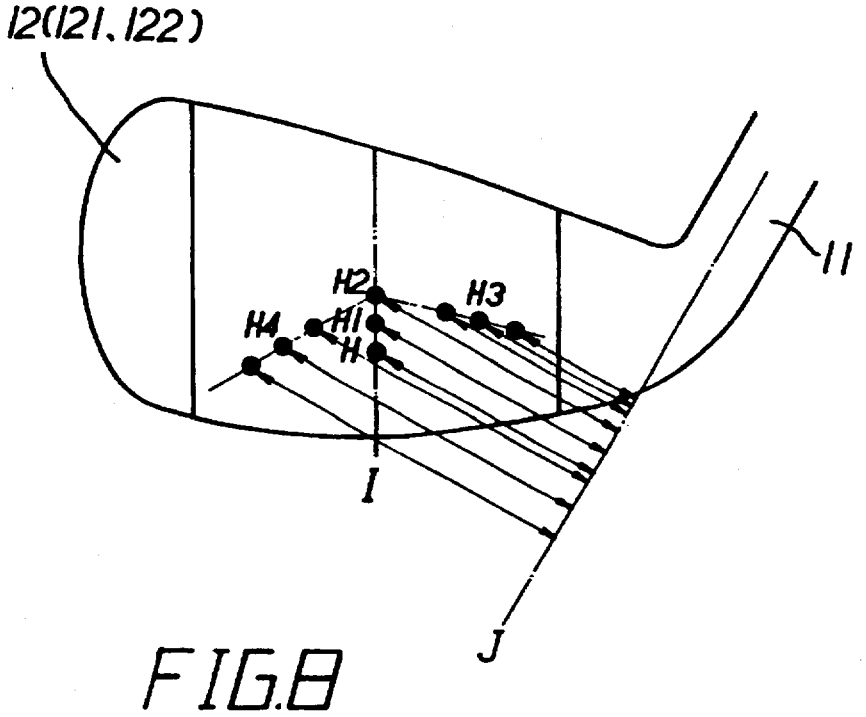
FIG. 8 is a schematic drawing explaining the relationship between the center of gravity and the torque according to the present invention.

Referring to FIG. 8, because the points H, H1 and H2 coincide with the straight line I, the respective vertical distances between the points H, H1 and H2 and the longitudinal central axis J of the neck 11 are approximately equal, and therefore they do not cause a different torque while striking. This problem is eliminated by changing the design of the back chamber 125 (see FIG. 7). As illustrated in FIG. 7, when the depth of the back chamber 125 reduces gradually toward the back side, the center of gravity is shifted backwards to point H3; when the depth of the back chamber 125 reduces gradually toward the front side, the center of gravity is shifted forwards to point H4. Therefore, by changing the design of the depth of the back chamber 125, the vertical distance between the center of gravity of the club head 1 and the longitudinal central axis J of the neck 11 is relatively changed. Because the front wall 121 of the casing 12 has a uniform thickness, the whole striking surface 122 is the sweet spot for striking the ball (see FIG. 5).

It is to be understood that the drawings are designed for purposes of illustration only, and are not intended as a definition of the limits and scope of the invention disclosed.

I claim:

1. A set of golf club heads comprising:

a casing and a neck at one end of said casing for connection of a club shaft, said casing comprising a front wall, a striking surface defined within said front wall, a plurality of scoring lines on said striking surface, and a smoothly curved back wall extended from said front wall, wherein:

said back wall has a bottom side connected to said front wall by a solid bottom wall, defining with said front wall a back chamber that is open on a top side thereof such that a center of gravity of said club heads is varied from club to club, said center of gravity is varied in the vertical direction by increasing and decreasing a thickness of said solid bottom wall, and said center of gravity is varied in the horizontal direction by changing a slope of said solid bottom wall, thereby allowing a user to create a full set of irons all having the same front wall.

2. The golf club head of claim 1 wherein said front wall of said casing has a uniform thickness.

3. The golf club head of claim 1 wherein the thickness of said back chamber is preferably within 3 mm to 20 mm.

* * * * *